United States Patent [19]

Holte

[11] 3,966,581

[45] June 29, 1976

[54] SELECTIVE PLATING APPARATUS

[75] Inventor: Paul C. Holte, Canton, Mass.

[73] Assignee: Auric Corporation, Newark, N.J.

[22] Filed: Oct. 16, 1974

[21] Appl. No.: 515,319

[52] U.S. Cl. ..... 204/202; 204/15; 204/198; 204/224 R

[51] Int. Cl.[2] ..... C25D 17/28; C25D 5/02; C25D 5/06; C25D 3/48

[58] Field of Search ..... 204/198, 202, 203, 204, 204/205, 224 R, 15

[56] References Cited

UNITED STATES PATENTS

| | | | |
|---|---|---|---|
| 2,591,042 | 4/1952 | Berman et al. | 204/202 |
| 3,740,323 | 6/1973 | Miyata et al. | 204/202 X |

FOREIGN PATENTS OR APPLICATIONS

| | | | |
|---|---|---|---|
| 700,918 | 3/1931 | France | 204/202 |
| 760,016 | 10/1956 | United Kingdom | 204/224 R |

*Primary Examiner*—John H. Mack
*Assistant Examiner*—A. C. Prescott
*Attorney, Agent, or Firm*—Stefan J. Klauber

[57] ABSTRACT

Apparatus for continuous electroplating of selected portions of discrete electronic components. The components are carried by a conveyor belt through an electroplating station where the portions to be plated make contact with a moving porous applicator surface wetted with the electroplating solution, while a D.C. potential is suitably applied. A stationary guide at the electroplating station accurately spaces the components with respect to the applicator, and restrains the components from undesired wobble or vertical movements. The discrete components include leads which are connected to electrically isolated terminals on the die-receiving face of the component. In order to assure effective plating, an electrical potential must be provided to both the die-receiving face and the isolated terminals. The conveyor belt is accordingly electrically conductive and has spaced openings for receiving the component bodies in nesting relationship; and lead contact means are provided which are electrically continuous with the conveyor belt and abound each opening, as to surround the group of leads extending from the nested component and effect a ring-like contact with said group to provide electrical continuity between the leads and conductive conveyor belt. An insulating belt sandwiches, and thereby retains the components in their nested positions, to, in turn, maintain the achieved electrical continuity.

9 Claims, 13 Drawing Figures

FIG. 7
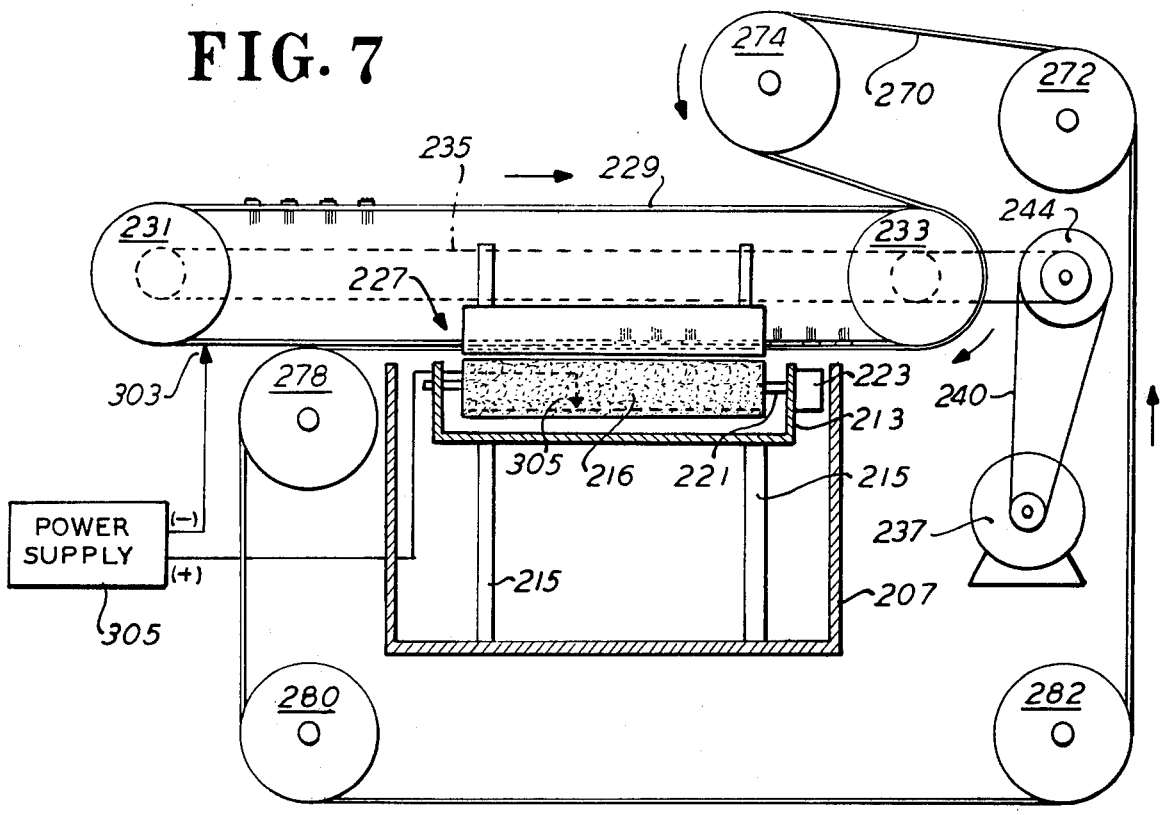
FIG. 8
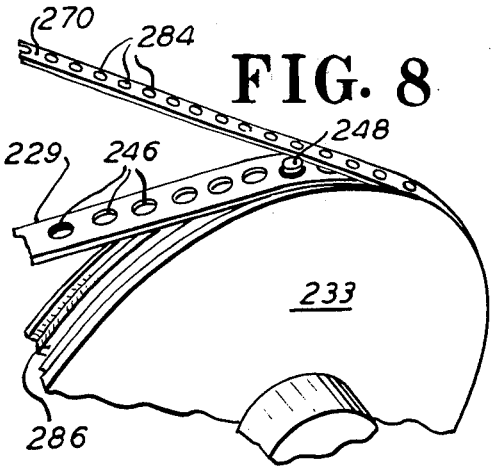
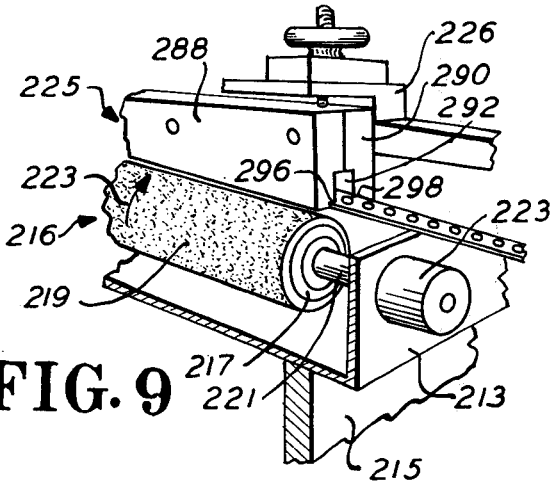
FIG. 9
FIG. 10A FIG. 10B FIG. 10C FIG. 10D
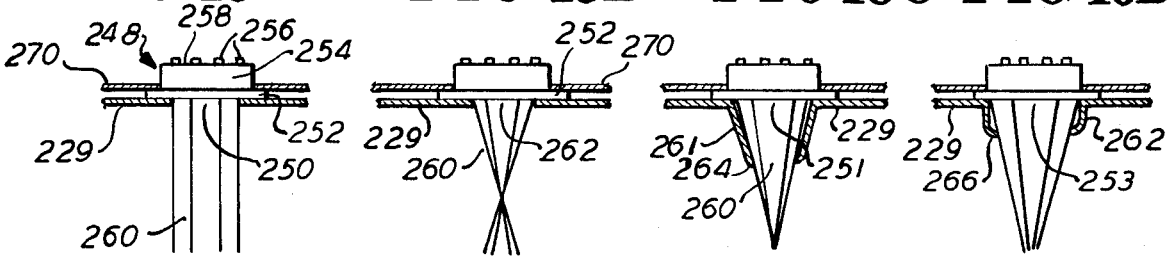

SELECTIVE PLATING APPARATUS

BACKGROUND OF THE INVENTION

This invention relates generally to electroplating apparatus and methodology, and more specifically relates to the electroplating with gold of electronic components or the like.

Gold, within recent years, has become a very important part of the electronics industry. Among those properties recommending its use therein, are its relative unalterability, high solderability and low contact resistance. In the semi-conductor field, gold has furthermore found favor because of its ability to readily form an eutectic alloy with silicon and germanium. In the latter connection it may be noted that most headers or packages for diodes, transistors, and integrated circuits are gold plated as a preparation for the mounting or attaching of semi-conductor devices. Such components are exemplified by the well-known line of TO-5 and TO-8 multi-lead headers. Such headers consist of an eyelet of Kovar metal to which several insulated Kovar leads are attached, and sealed in glass.

In accordance with known principles in the art, headers of the foregoing type have, in the past, been plated (among other methods) by so-called barrel plating techniques — that is, by subjecting such articles to electroplating while a plurality of articles tumble in a barrel. These barrel techniques, however, have any important drawbacks, numerous of which are recognized in the art. For example, where headers or the like are thus plated, it is found that many leads do not make electrical contact with the remainder of the load. Where such conditions obtain during the plating cycle, the portion of the lead closest to the anode becomes cathodic. Such leads become bipolar, and at the anodic portion of the leads problems can arise in that the gold may redissolve anodically, and as well base metal can be attacked to expose bare spots. Where the tumbling action is markedly inadequate these problems can become quite severe. In the past these problems have partially been overcome by incorporating mechanical means for improving electrical conductivity through the load. Such means have taken the form of metal particles or metal slot. Unfortunately during plating operations the slot itself becomes gold plated, resulting in the loss of gold and attendant increase in the cost of plating the desired objects, that is, the headers, etc.

Within recent years, particularly because of the soaring price of gold, it has furthermore been increasingly appreciated that barrel plating techniques (and as well, common rack plating techniques) are exceedingly wasteful of the gold itself. If one considers, for example, the most common use of barrel plating in the electronic industry, i.e. the plating of the aforementioned headers, it will be appreciated that basically one is only interested in providing a plating at the die-receiving face thereof, and at the contact connections for the header leads which are present at the said face. Barrel plating techniques, however, are such that the entire header is plated with gold — including all electrically conductive, accessible portions thereof. Furthermore, since barrel plating is based upon the development of multiple electrical contacts among the tumbling components, it is basically a statistical process, this is to say that different components in a tumbled load may be subjected to markedly different plating times. In order to achieve a desired means plating thickness, it is therefore necessary to groosly overplate. In order to assure that all of the individual components in the batch receive adequate plating, it is frequently necessary to overplate many of the components by as much as 10% to 20%. This is obviously a further waste of the precious gold material.

In the copending patent application of Frank J. Johnson, filed July 13, 1973, and entitled "Apparatus and Method for Continuous Selective Electroplating", Ser. No. 379,113, now U.S. Pat. No. 3,904,489 which application is assigned to the same assignee as the instant application, there is disclosed apparatus and method which are highly effective in overcoming the foregoing problems of the prior art. The said apparatus in particular, is adapted to enable continuous electroplating of selected portions of discrete electronic components or the like. In accordance with the Johnson apparatus an applicator belt adapted for carrying electroplating solution on the surface thereof, is continuously moved through an electroplating station. Electroplating solution is applied to the belt at a point in the progression thereof which is upstream of the electroplating station, as for example, by passing the belt (which may be in the form of a loop) through a reservoir for the solution. The discrete components to be selectively electroplated are arrayed in a line, and are conveyed across the surface of the moving plate belt, with the portions of the components to be plated in contact with electroplating solution on the belt. The direction of movement of the components is generally counter to the movement of the plating belt, and is more specifically at a skewed direction with respect to the direction of movement of the said belt. The angle of skewing in relationship to the speed of progression of the plating belt and of the components, is such that a trace of each component upon the plating belt continuously overlies fresh electroplating solution; which is to say that the various components are continuously wiped by fresh electroplating solution. A D.C. electrical potential appropriate to enable the desired electroplating, is applied between the component portions to be plated and the backside of the plating belt.

In accordance with the concepts set forth in the said Johnson application, the means for conveying the discrete components through the electroplating station preferably comprise a pair of parallel moving conductive belts, the spacing between the belts defining openings for supporting the components to be plated. The portions selected for plating therefore project beneath the conductive belt during passage through the station. As the borne components approach the station in Johnson an electrically non-conductive gripper belt passes atop the components as to sandwich same with the pair of conducting belts underlying the component. In order to effect electrical contact with the wire-like leads which extend upwardly from the conveyed components, a further movable belt, provided with a resilient conductive surface contacting the leads, is made to move with the conductive and gripper belts through the electroplating station.

While the aforementioned Johnson apparatus has, as indicated, been found effective for its purposes, it has nevertheless been observed that the apparatus is less than ideal as respects performance and reliability characteristics thereof. A principal difficulty arises from the conveying system, which is overly complex — as regards its basic mode of transporting the said components. The parallel moving belts, for example, require frequent adjustment, and relatively minor imperfections in the belts or in their relative spacing or rates of movement, can lead to lack of uniformity in the plating of individual components. It is, furthermore, difficult with the relatively flexible Johnson conveying arrangement, to provide and maintain accurate spacing from the solution applicator belt as the components pass through the plating station; and indeed the components may even undergo wobble about their longitudinal axis due to the absence of restraint against such motions. Similarly, application of electrical potential to the conveyed workpiece is effected in relatively complex fashion — which can comprise an additional impediment to dependability of performance. This is particularly true as respects the manner in which electrical contact is effected with the aforementioned wire-like leads.

In the copending application of Maurice Bick et al, Ser. No. 474,952, filed May 31, 1974 and entitled "Selective Plating Apparatus", which application is assigned to the assignee of the present application, there is disclosed selective plating apparatus, which while bearing a superficial resemblance to the aforementioned Johnson device, improves same in several important respects. For example, the said improved apparatus is characterized by an arrangement wherein the conveyor belt for the discrete components passes through a channel in a stationary guide means at the electroplating station, which guide means accurately spaces the components with respect to the applicator, and restrains the components from undesired wobble or vertical movements. The leads of the components, which, as already indicated, are connected to electrically isolated terminals on the die-receiving face of the components, protrude from the guide as they progress through the channel therein. Electrical contact with the leads, for purposes of plating the isolated contact terminals, is made by a flexible conductor — which at least in one embodiment of the invention disclosed may be a brush or similar conductive surface which is maintained stationary as the components are swept past same with the leads in contact with the brush.

It will be clear from the prior art thus far discussed, that a central and most significant problem arising in the course of electroplating components of the type considered herein, is one of applying an electrical potential to the electrically isolated contacts — which must be so provided if effective electroplating is to ensue. This difficulty basically resolves to one of providing such potential to the flexible wire leads which extend from the body of the component. In general, the various flexible surfaces — both moving and stationary — which have been described for this purpose in the past, have not been completely acceptable. Among other things it may be noted that where relative movement between the flexible surface and leads is involved, (i.e. where a brush is fixed with respect to the moving components) it is all too often the case that such potential is not uniformly or continuously applied to each of the isolated leads; and similarly it is all too easy to damage the leads during the process. A conductive surface moving with the components, poses somewhat similar problems, which can be compounded by the fact that in the absence of relative movement between the conductive surface and leads, one can no longer depend upon the likelihood that if one or more leads are not initially contacted they will be so contacted eventually as the relative movement between leads and conductive surface continues.

In accordance with the foregoing, it may be regarded as an object of the present invention to provide apparatus enabling on a mass production basis, the electroplating of selected portions of electronic components or the like, thereby eliminating the waste of plating metals previously occurring where the said components were subjected to gross plating thereof.

It is a further object of the present invention, to provide apparatus enabling selective electroplating of electronic components or the like with gold, or similar precious metals, which apparatus enables such operation on a continuous basis, which results in platings of excellent quality and carefully controlled thicknesses, and wherein the uniformity of plating thickness and quality from piece to piece is correspondingly high.

It is a yet further object of the present invention, to provide apparatus for selective electroplating of electronic components or the like, which is of improved dependability of operation in comparison to prior apparatus, and which is greatly simplified in comparison to such prior apparatus, thereby enabling greatly increased effectiveness in realized results.

It is a still additional object of the present invention, to provide apparatus for selective electroplating of electronic components or the like, which enables dependable, highly uniform and non-damaging contact to be effected to the electrically insulated wire leads extending from the bodies of such components, whereby to assure that uniform and dependable plating occurs at the individual contacts associated with each of the said wire leads.

SUMMARY OF INVENTION

Now in accordance with the present invention, the foregoing objects, and others as will become apparent in the course of the ensuing specification, are achieved in apparatus wherein the discrete electronic components are carried by a conveyor belt through an electroplating station, where the portions to be plated make contact with a moving, porous applicator surface wetted with electroplating solution, while a D.C. potential is suitably applied. The respective movement of conveyor and applicator surfaces are such that the trace of each conveyed component upon the applicator surface continuously overlies fresh electroplating solution. Thus the applicator surface may be present upon an electrically conductive cylindrical roller provided with a fabric or fibrous covering capable of retaining electroplating solution applied thereto. The conveyor belt passed through a channel in a stationary guide at the electroplating station, which accurately spaces the components with respect to the applicator, and restrains the components from undesired wobble or vertical movements.

The discrete components include leads which are connected to electrically isolated terminals on the die-receiving face of the component. In order to assure effective plating, an electrical potential must be provided to both the die-receiving face and the isolated terminals. The conveyor belt is, accordingly, electrically conductive, and has spaced openings for receiving the component bodies in nesting relationship; and lead contact means are provided which are electrically continuous with the conveyor belt and abound each opening, as to surround the group of leads extending from the nested component and effect a ring-like contact with each group to provide electrical continuity between the leads and conductive conveyor belt. The nesting openings are preferably defined by formed-out cups in the belt. The bottom opening of each cup defines a rim portion, which is electrically continuous with the belt but spaced from the plane of the belt and of lesser diameter, than the belt openings. Upon the component being placed in its nested position, the rim portion surrounds and engages with the wire leads, while slightly compressing same, thereby assuring electrical continuity between the leads and belt. An insulating belt sandwiches the components in their nested positions, thereby maintaining said components in contact with the conveying belt, and the leads in contact with the aforementioned rim portions.

BRIEF DESCRIPTION OF DRAWINGS

The invention is diagrammatically illustrated, by way of example, in the drawings appended hereto, in which:

FIG. 7 is a schematic diagram illustrating the basic mode of operation of the FIG. 6 apparatus.

FIG. 8 is an enlarged perspective view of a portion of the FIG. 6 apparatus, and illustrates the manner in which components are nested in the conveyor belt and retained therein by the keeper belt.

FIG. 9 is an enlarged perspective view of portions of the conveyor belt guide means and of the applicator means; and FIGS. 10A through 10D are cross-sectional views through conveying belts of the type shown in FIG. 8, and schematically illustrate the effects of forming the openings of the said belt in various configurations.

DESCRIPTION OF PREFERRED EMBODIMENT

Figure 1:
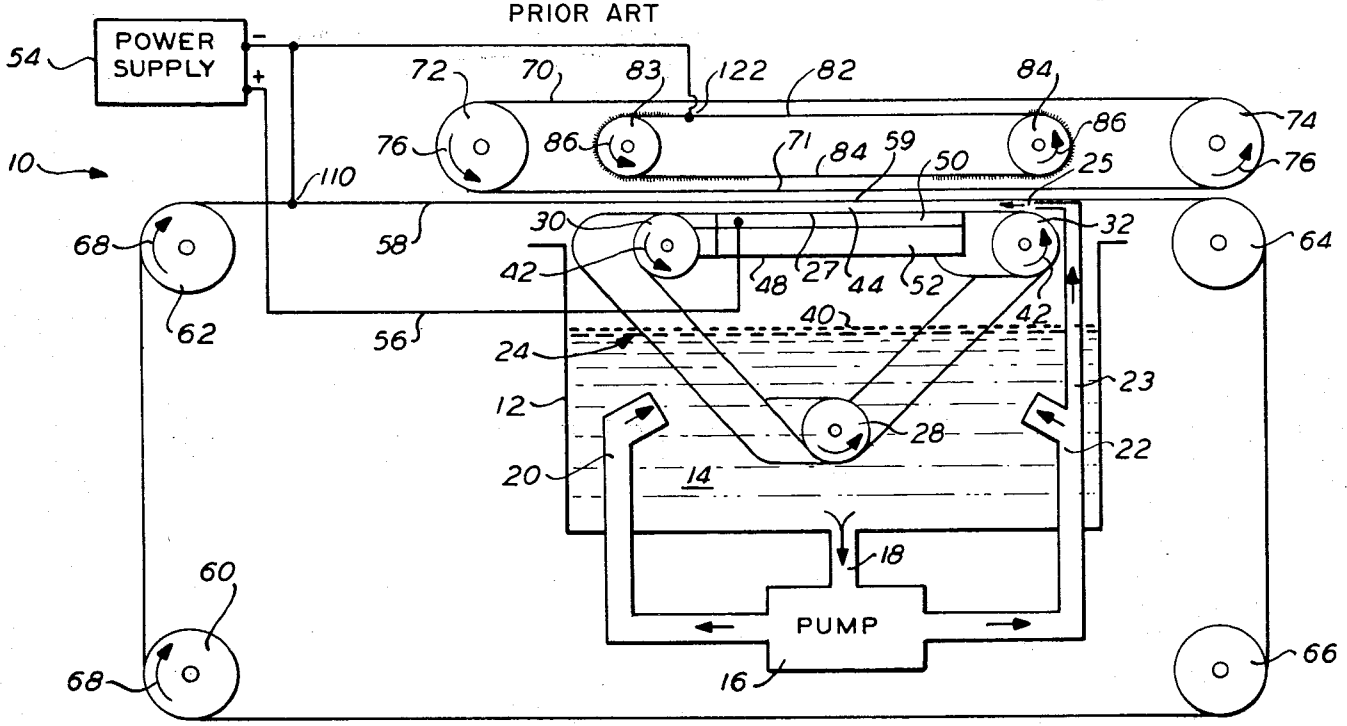
FIG. 1 PRIOR ART
FIG. 1 is a schematic, elevational view of electroplating apparatus in accordance with the aforementioned Johnson application.

In FIG. 1 herein an elevational, highly schematic view appears of the electroplating apparatus 10 in accordance with the aforementioned Johnson application. It will be understood that the ensuing description of this Johnson invention, is being set forth for purposes of facilitating understanding of the improvements made by the applicants herein, and also in order to fully set forth those elements which are common to Johnson's apparatus, and to the present improvements.

Apparatus 10 is particularly adapted for use in electroplating of electronic components, such as the well-known TO-5 and TO-8 multi-lead headers which have heretofore been mentioned. The use of apparatus 10, as well as of the presently to be described improvements, will accordingly be particularly described with reference to such application, but it will become evident that such apparatus is utilizable (with suitable structural modifications in the conveying belts, etc.) with various other electronic components, as well as with other discrete objects as may require electroplating at selected portions thereof. Similarly, and as will also become apparent, while the apparatus considered in this specification is particularly valuable and intended for use in the plating of precious metals, particularly gold, there is no necessity whatsoever for so limiting its use, and accordingly electroplating solutions other than gold, as are known in the art, may be utilized therewith.

Electroplating apparatus 10 is seen to include a reservoir 12 for electroplating solution 14 carried therein. Reservoir 12, which is a simple tank of suitable materials as are compatible with and resistant to solution 14, is provided with pump means 16, having an inlet 18 from reservoir 12, and outlets 20 and 22 for returning the solution to the reservoir. Pump 16 serves primarily to provide continuous or semi-continuous agitation of the electroplating solution, and may be provided with filters, etc. for removing sediment or the like from the solution passing therethrough. Since apparatus 10, as has been previously indicated, is of particular use in gold electroplating applications, the solution 14 (although not per se comprising part of the present invention), commonly comprises an aqueous solution of an alkali-gold-cyanide, together with suitable buffering compounds, conductivity salts, and other agents as may be known in this art to be useful in promoting the production of high quality gold platings.

Positioned for cooperation with reservoir 12 is an electroplating solution applying means 24. Means 24 is based upon a plating belt 26, which is formed as a continuous loop, and passes about a series of rollers 28, 30 and 32, one or more of which may be driven by motor means (not shown in the present drawing). Plating belt 26, as seen in the enlarged view of FIG. 4, typically comprises a fabric backer 34 of Dacron or the like, to which is secured a fibrous nap 36, as for example, of Dynel. A structure of this type is basically similar to the applicator material of common paint rollers, and to similar means utilized in the past for applying decorative coatings to surfaces by contact therewith. In the present instance a primary consideration is, of course, that the specific fabric materials utilized, be compatible with the electroplating solution — i.e. not subject to attack thereby.

As is seen in FIG. 1, the lower portion of means 24 are beneath the surface 40 of plating solution 14, in consequence of which as the belt moves in the direction of arrows 42, a continuous supply of electroplating solution is brought to the electroplating station — which is generally designated at 44. The supply of electroplating solution on belt 26 is augmented by means of a duct 23, which discharges a portion of the pumped liquid through a nozzle 25, so that the liquid impinges on the basis as the latter approaches plating station 44. Discharge of electroplating solution in this manner, not only assures an abundant supply of same at the plating station, but moreover introduces such liquid at the relatively high temperatures of the reservoir 12 (which may be thus maintained by heaters or the like). These elevated temperatures are of considerable significance in achieving fully acceptable platings at station 44.

Figure 2:
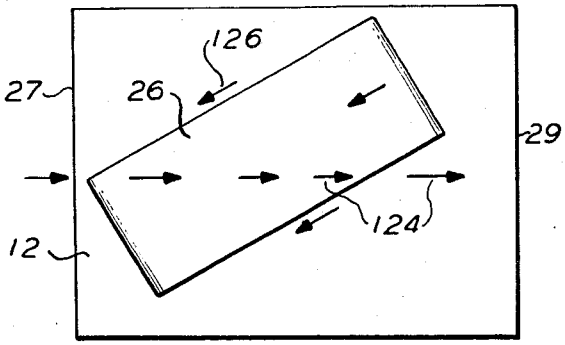
FIG. 2 PRIOR ART
FIG. 2 is a schematic plan view, looking downward toward the electroplating solution reservoir of the FIG. 1 device, and illustrating the relationship between the respective directions of movement of the plating belt, and of the components being plated by the apparatus.

Solution applicator means 24 is so mounted with respect to reservoir 12, that the direction of movement of belt 26 is not parallel to the plane of the drawing, but rather, as is apparent from the plan view of FIG. 2 herein, is skewed with respect to the said plane. Assuming that reservoir 12 thus has the rectangular geometry therein shown, it is apparent that the lengthwise orientation of belt 26, and its direction of movement 126, are skewed at an acute angle of the order of 60° with respect to the walls 27, 29 or reservoir 12, respectively depicted at the left and right sides of that structure.

In order to provide the anodic potential required at electroplating station 44, it is further seen that belt 26 as it progresses through the said station, passes in overlying relationship to an anode backing electrode 48, which may consist of a support plate 52 and an anode plate 50. The required positive potential for electrode 48 may be provided by means of a conventional D.C. power supply 54 which connects to plate 50 by means of a lead 56. Lead 56 may also connect through support plate 52 if the latter is suitably conductive and electrically continuous with plate 50.

A lower conveying belt means 58, preferably again in the form of a continuous loop, passes completely about the reservoir 12, and is guided by a series of rollers 60, 62 64 and 66, one or more of which may be driven by conventional motor means (not shown in the drawing). These rollers rotate in the direction indicated by arrows 68. The configuration of belt means 58 is seen to be such that a portion 59 of the belt means passes essentially in a flat plane through the electroplating station 44, at a position somewhat above a corresponding flat portion 27 of the solution-carrying plating belt 26. Spaced slightly above the path of movement of belt means 58 at plating station 44, is a gripper belt means 70, which passes about the rollers 72 and 74, one or both of which may be driven by conventional motor means not shown in the drawing. These rollers progress in the direction indicated by arrows 76. Gripper belt means 70 includes a flat portion 71 at the region where means 70 passes through station 44. Finally, there is seen to be mounted for movement within belt means 70, a cathodic lead contact belt 82. This latter belt is also mounted upon a pair of guide rollers 83 and 84, which rotate in the direction of arrows 86. One or more of rollers 83 and 84 are driven by motors means, not explicitly shown in the present drawing. As is the case with belt means 26 and 70, belt 82 includes a portion 84 which passes through plating station 44, substantially in a plane. The motive means driving the aforementioned belt structures 70 and 82 are so geared or otherwise regulated, that the linear rate of progression of portions 71 and 84 are substantially equal at the plating station 44.

Figure 3:
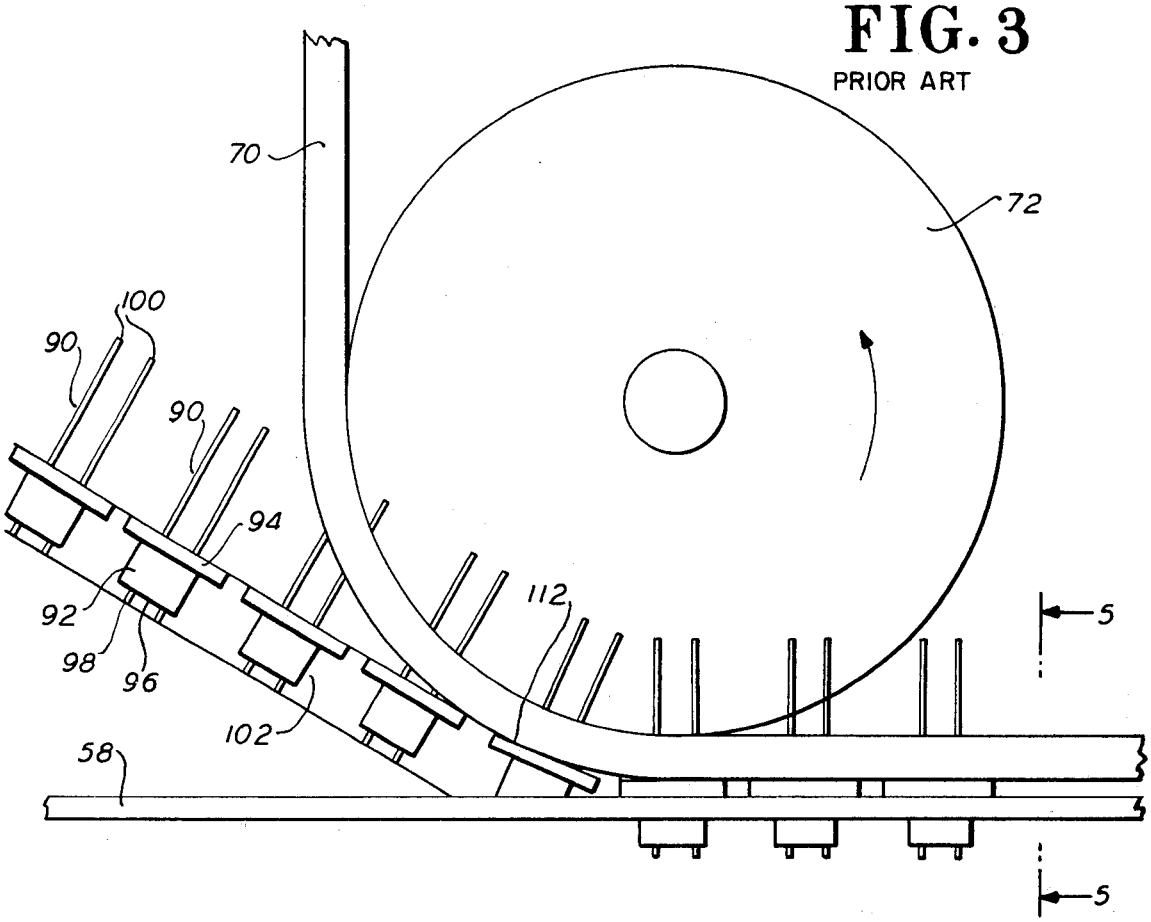
FIG. 3 PRIOR ART
FIG. 3 is an enlarged view of a portion of the FIG. 1 apparatus, and illustrates the manner in which components to be plated by the apparatus are conveyed through the electroplating station.

Referring now to the enlarged schematic view of FIG. 3, the basic technique of conveyance for a series of components 90, is set forth. For purposes of concrete illustration, component 90 is deemed to constitute a multi-lead header of the type previously discussed herein. These headers are not shown in any great detail, in view of the fact that their construction is conventional and well-known. Such construction is seen, however, to include a body portion 92 provided with an enlarged lip or rim 94. The bottom of the header terminates at a die-receiving face 96. As is well known in this art, the face is surrounded by a plurality of terminal connections 98. In order to illustrate the invention more clearly, connections 98 have been exaggerated in scale — as have certain other attributes of the header, including the diameter of lip 94 in comparison to that of body 92. In point of fact connections 98 consist of a conductive terminal which is separated from the rest of body 92 by an insulating collar or the like. This type of structure, for example, may be seen at page 5 of the standard handbook "RCA Linear Integrated Circuits" (1970) available from the Solid State Division of RCA, Somerville, N.J. 08876. The several connections 98 are in electrical continuity with a corresponding number of leads, two of which are shown at 100. These leads are again exaggerated in scale for purposes of simplicity. In practice, and as is known in the art, (see e.g. the cited RCA reference) an integrated circuit chip or the like, is intended to ultimately be positioned at die-receiving face 96, with connections being made to the secured chip via the several connectors 98; thereafter the leads 100 enable (in the finished package) microscopic connections to be made to the packaged chip.

The plurality of components 90 are fed into the present apparatus 10 in line form. The components may be arrayed by simple hand-feeding operations, or by simple automatic devices. For purposes of illustration a simple inclined track 102 is shown enabling a continuous in line feed of the said components. As the components descend to the bottom of track 102 they impinge upon and are supported by the belt means 58 discussed in connection with FIG. 1. Belt means 58 comprises an electrically conductive material, preferably a stainless steel. As is best seen in the detail cross-section of FIG. 5, taken along the line 5—5 of FIG. 3, belt means 58 is so constituted that an opening 104 is defined therein, which is appropriate to support the lip portion 94 of component 90 thereon. Preferably belt means 58 comprises two distinct stainless steel belts 106 and 108, which move parallel to one another at a common speed, whereby the spacing between the two belts 106 and 108 defines the said opening 104. By varying the lateral spacing between the two belts 106 and 108, the opening 104 may be rendered such as to support components of differing sizes. In actual practice, although exaggerated in the present drawing, the lip 94 projects very slightly from the remaining body 92 (in a typical header about 0.010 projection), so that the belts 106 and 108, which must be quite thin in order not to interfere with electroplating action, may be quite wide, for example, of the order of ¾ in width, in order to enable sufficient tensile strength at the points of support. This point may be better appreciated by noting in FIG. 3 that once the component 90 is supported on belt means 58 it is desired that the portions to be electroplated — specifically the face 96 and connections 98 — project below the plane of the belt means 58 to enable the said electroplating.

Belt means 58, constituting the two conductive belts 106 and 108 are rendered cathodic by means of wiping electrical contacts 110 connected to the negative side of power supply 54. Such wiping contacts may constitute conventional brush elements as are commonly utilized for these purposes, including without limitation metal brushes, graphite brushes, or the like; and similarly wiping contact plates, or so forth may be used.

Figure 5:
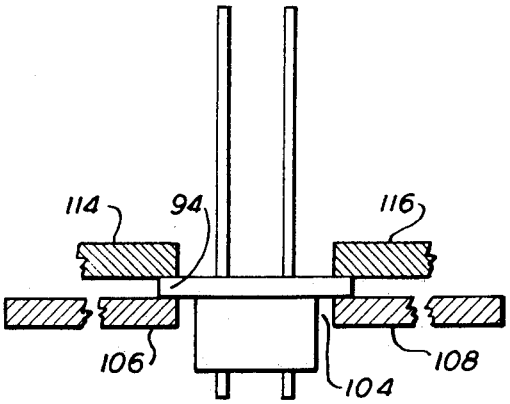
FIG. 5 PRIOR ART
FIG. 5 is a cross-sectional detail view, taken along the direction 5—5 of FIG. 3, and illustrates the manner in which a typical component treated by the FIG. 1 apparatus is supported during its transport through the electroplating station.

In order to assure stability of the components 90 as they are conveyed through electroplating station 44, the upper or gripper belt means 70 engages an upper face of component 90, so as to sandwich the components in a firm manner as it passes through station 44. This action is best seen in FIG. 3 from whence it is noted that the belt means 70, preferably comprising a natural or artificial rubber such as neoprene, after passing about roller 72, is brought to bear upon the upper face 112 of body 92. Gripper belt means 70 may again comprise a pair of parallel moving laterally spaced belts 114 and 116, as seen in FIG. 5. These belts, like belts 106 and 107, are adjustable laterally with respect to one another (by being moved laterally on their rollers) so as to enable apparatus 10 to process components of differing widths.

Figure 4:
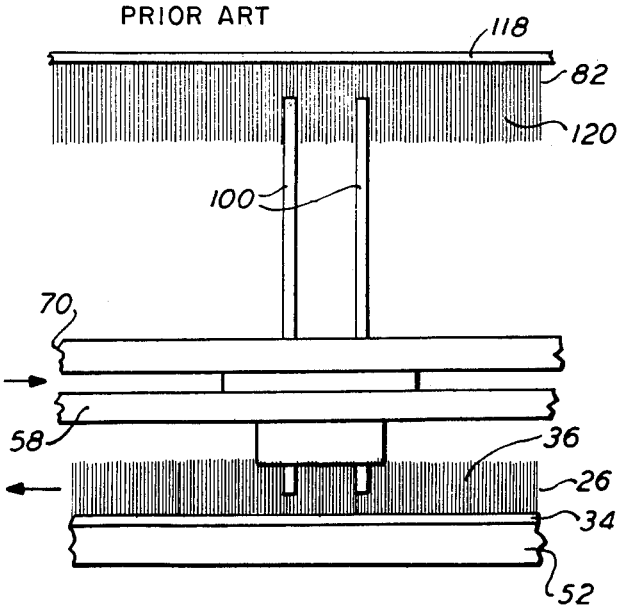
FIG. 4 PRIOR ART
FIG. 4 is an enlarged view of a portion of the electroplating station of the FIG. 1 apparatus, and illustrates the manner in which the required electrical contacts are achieved at the station, and the technique by which electroplating solution is applied.

In FIG. 4, a considerably enlarged view is apparent of a component 90 passing through a typical mid-range point at station 44. In this view the function of the cathodic lead contact belt 82 becomes apparent. As is best seen in that Figure the said belt 82 preferably comprises a substrate 118 the material of which is preferably conductive, although non-conductive material can be utilized depending upon the nature of the flexible lead contact layer 120 secured thereto. The said flexible lead contact layer 120, may suitably comprise steel filaments or the like, or even appropriate grades of steel wool, etc. Similarly, the said layer 120 may suitably comprise a relatively flexible conductive rubber, such as graphite-impregnated neoprene or the like. The function of conductive layer 120 is to assure that a cathodic potential is provided to the terminal connections 98. Since, as has been previously indicated, these connections are actually insulated from the remainder of body 92, the negative electrical potential applied through wiping contact is only useful in rendering face 96 cathodic. By applying, however, a potential to layer 120, as for example, by means of the wiping contact 122 (which is similar in structure to contacts 110, and which engage with layer 120 where the elements of the layer are sufficiently intertwined to create electrical continuity, but which preferably engages the substrate 118, with the latter element being conductive) a potential is enabled to each of the leads 100, which in turn enables the negative potential at connections 98.

Returning now to the schematic depiction of FIG. 2, the full significance of the skewed directional movements between, respectively, the belt 26 and the progressing array of conveyed components 90, may be fully appreciated. Referring to that Figure the path of progression of components 90 is indicated by the trace of arrows 124 — which is the projection of the path of movement of the said components upon belt 26. Firstly, it is noted in that Figure that the general direction of movement 126 of belt 26 is opposed to the direction of movement of the components. As is best seen, however, by referring to FIG. 4, the basic scheme pursuant to which the desired portions (namely, face 96 and connections 98) are electroplated, involves passage of the said portions over the surface nap 36 of plating belt 26, whereby the electroplating solution carried by nap 36 contacts those portions of components 90 desired to be plated in the presence of a potential difference established by anode plate 34 and the cathodic potential applied either by belt means 58 or by flexible conductive layer 120. In order, however, for this process to be fully effective, it will be appreciated that each of the successive components forming part of the array, should be brought into constant contact with fresh electroplating solution. Accordingly, by examination of FIG. 2, it will be apparent that effective results will not be achieved were a given component to pass over a portion of belt 26 that had previously been depleted of electroplating solution by a component immediately preceding the one being considered. Accordingly, in order to assure that fresh solution is thus applied, the direction of movement of belt 26 is substantially skewed with respect to the trace of arrows 124. The precise angularity of skewing will, of course, be a function of the velocity of relative movement of the belt 26 and of the conveying belts 58 and 70 which advance the components 90, as well as of the spacing between components; but the several elements will be interrelated so that a condition is achieved, whereby successive components in the advancing array are not brought into contact with areas on the belt 26 previously depleted of solution by other components. As has already been discussed, and as is apparent in FIG. 2, a representative and useful degree of skewing is an angle of the order of from about 150° to 135° between the two directions of advance; but angles of greater than 150° may be used depending upon the factors previously mentioned, and angles to at least 90° or less may be effectively utilized.

While apparatus 10 has been particularly illustrated for the simple case where a single aligned array of components is advanced into the apparatus, it will be apparent that multiple parallel component lines can be treated by substantially similar apparatus and methodology. In these further cases, however, multiple groupings of conveying belts, and as required multiple electrical contacts, are utilized, in order to assure similar results.

Figure 6:
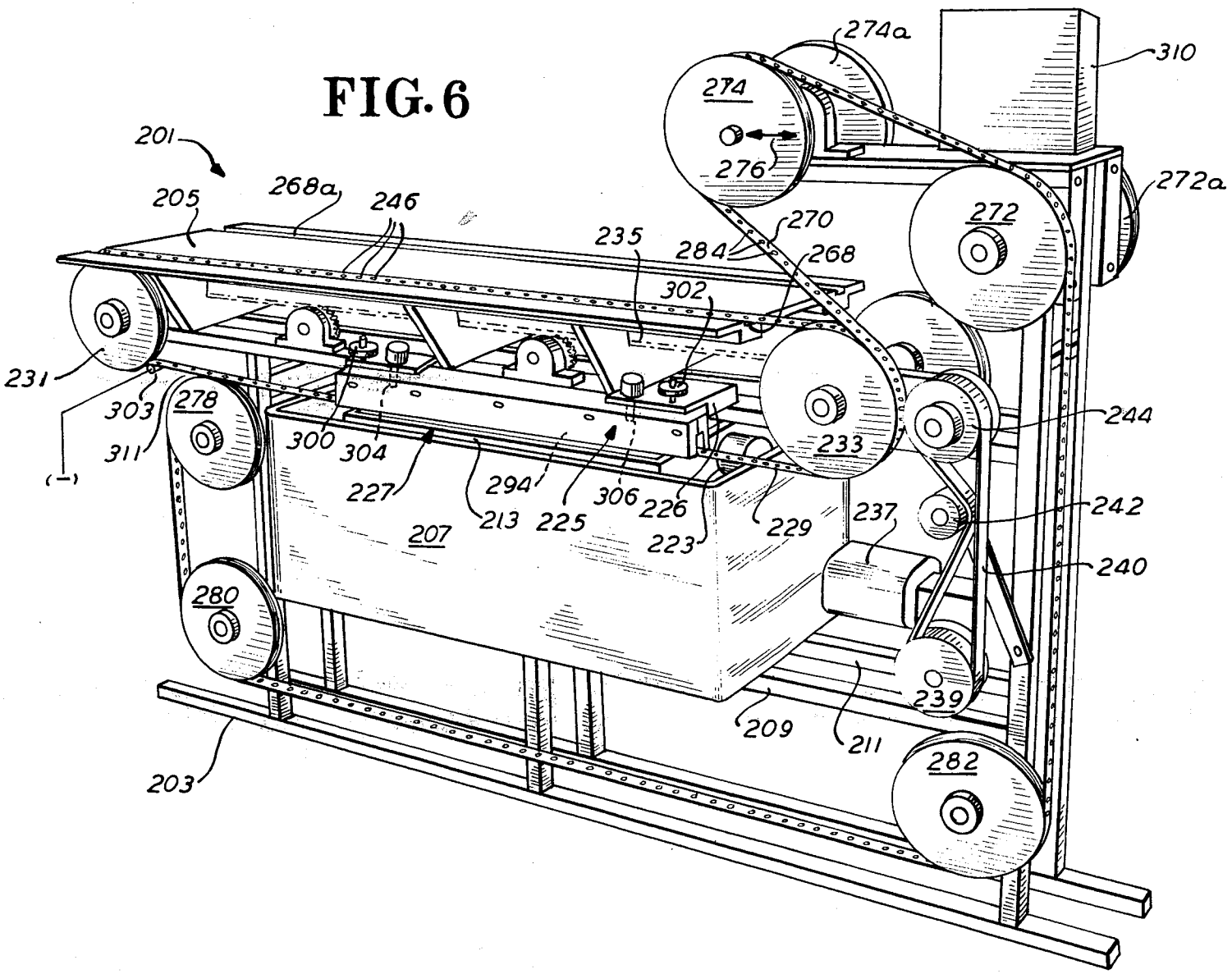
FIG. 6 is a perspective view of a preferred embodiment of improved selective electroplating apparatus in accordance with the present invention.

In FIG. 6 a perspective view appears of improved selective electroplating apparatus 201 in accordance with the principles of the present invention. Apparatus 201 has a number of points of superficial resemblance to the Johnson apparatus heretofore discussed, but numerous and highly significant distinctions are present — as will become apparent. An important point of similarity, however, which should usefully be kept in mind throughout the present discussion, is that apparatus 201 is basically intended for use in the selective electroplating of headers and similar electronic components of the same type treated by the Johnson apparatus.

In considering FIG. 6, and also the more detailed fragmentary perspective views of FIGS. 8 and 9, cross-reference may usefully be had to the elevational schematic diagram of FIG. 7, in which the several moving belts are shown (in simplified fashion) with respect to the other operational portions of the apparatus. It will be noted that similar components are identified by corresponding reference numerals in the several Figures mentioned.

Apparatus 201 is seen to include a support stand 203 to which is affixed a loading table 205. A tank 207, of plastic or similar chemically-resistant materials, is supported upon longitudinally extending members 208 and 211, the said tank containing electroplating solution used in the apparatus. Tank 207 may include a heater (not shown) at the bottom thereof, to maintain a desired temperature in the electroplating solution. An inset solution trough 213 is mounted within tank 207 upon legs 215 which extend to the bottom of the tank. The electroplating solution applicator 216 in the present invention (FIG. 9) preferably takes the form of a conductive cylinder 217, provided with a fabric or porous sleeve 219, such as of dynel or similar chemically resistant material, having a good nap or pore structure. The entire cylinder and sleeve thus resemble a somewhat oversized paint roller. Cylinder 217 is mounted upon axle 221, which, in turn, is journaled in the walls of tank 207, and is driven by an electric motor 223 at a relatively constant rate of rotation. It is seen that the solution applicator means is so mounted that the bottom portions of the sleeve 219 may constantly rotate through the electroplating solution which is constantly fed into solution trough 213, via a pump and tubing arrangement not shown. Thus, as cylinder 217 rotates in the general direction of arrow 223 it will be evident that a fresh supply of electroplating solution continues to be deposited upon sleeve 219, which then turns until the wetted zone on the sleeve lies proximate the bottom portions of guide means 225 — which element will shortly be discussed.

Components such as the headers heretofore discussed, are conveyed to the electroplating station generally indicated at 227, by means of an electrically conductive conveying belt 220. Belt 229 is formed as a closed loop, which passes at opposite ends about drive rollers 231 and 233, each of which is driven via chain 235. The latter in turn, receives its power from a motor 237 via a roller 239, drive belt 240, idler 242 and drive wheel 244 on the power axis for the apparatus.

As best seen in FIG. 8, conveying belt 229 is provided with a plurality of circular openings 246 at which may be received components 248, which are to be selectively plated in accordance with the invention. An electrically insulating keeper belt 270 coacts with conveying belt 229, to retain each of the components in its nested position. Keeper belt 270 preferably comprises a flexible plastic material such as e.g. mylar. The belt is seen to pass about a driven roller wheel 272, thence over an idler wheel 274, which may be moveable in the direction of arrow 276 in order to adjust the tension in belt 270. Keeper belt 270 thence merges with conveying belt 229 at driving roller 233, then is looped about idlers 278, 280 and 282 in a closed configuration. Keeper belt 270, as best seen in the enlarged perspective fragmentary view of FIG. 8, includes a series of circular openings 284, which as also seen in FIGS. 10A through 10D, slip over the body portions 254 of the components, and thence sandwich the adjacent side of lips 252 so as to firmly seat the components in their nested positions. The roller wheel 272 is preferably provided with protuberances (not seen in the drawing) which acting in the nature of cogs, engage with the openings 284 to thereby assure that undersired slippage of the belt does not occur — which could affect proper registration between openings 284, and bodies 252 of the components. The registration process, as it occurs, is best seen in FIG. 8. It should also be mentioned here that the drive roller 233 of FIG. 8, is provided with a slot 286 extending about the circumference thereof, so that the leads 260 will not be damaged as the belts 229 and 270 rotate about the said roller.

Individual components 248 are nested within the openings 246 of conveying belt 229 in a manner that may be best appreciated from examination of the cross-sectional views of FIGS. 10A through 10D. The latter views, which are schematic in nature, illustrate how various configurations for openings 246, affect the performance characteristics thereof. Referring firstly, to FIG. 10A, a component 248 is shown positioned at an opening 250, which is essentially a directly punched-out hole. The diameter of opening 250 is such that lip 252 of component 248 is adequately supported at the periphery of the opening. Good electrical contact is made with the lower side of lip 252, (the lip being sandwiched on its upperside by keeper belt 270) so that, as will be shortly apparent, an electrical potential may be suitably applied to the body 254 of the component. Recalling, however, that it is necessary to achieve electroplating of the various electrically isolated contacts 256 at die-receiving face 258, it is, of course, necessary that potential be applied as well to each of the wire-like leads 260 which extend downwardly through opening 250. It will be apparent that in the FIG. 10A arrangement, a ring-like contact with the leads is made by the periphery of opening 250; however, the size of the opening is such that dependable contact with all leads is not likely to be effected.

In the arrangement of FIG. 10B the opening 262 is substantially reduced in diameter, so that while lip 252 remains fully supported, a good degree of compression is applied about the extending leads 260. While this arrangement is more effective in assuring application of electrical potential to all leads, the leads tend to become so crowded that distortion and damage is likely to occur.

Preferable arrangements for effecting electrical contact with the extending leads 260, are shown in FIGS. 10C and 10D. In both of these instances the openings 251 and 253 are defined not by direct punched-out portions in the belt, but rather by formed-out cups. This is to say that cup-like portions at 261 and 262, extend downwardly from the openings 251 and 253, and are turned in at their bottoms to define rims 264 and 266, which rims are thus spaced from the main plane of belt 229. The rims 264 and 266 thus contact the downwardly extending leads 260 well below the plane of the said belt. In fact, in FIG. 10C contact is made at about 40% of the distance from the plane of belt 229 to the terminal ends of leads 260; and in FIG. 10D contact is made approximately 20% of the length along said leads. In both of these instances it is found that the arrangement assures that the leads retain sufficient spring tension for good contact, while at the same time little or no damage is effected to the leads.

Referring to both FIGS. 6 and 7, the components 248 may be inserted into belt 229 at any point along the loading table 205. Simple loading rack means as has been discussed in connection with FIG. 3 may be used for this purpose; or more sophisticated loading devices adapted to release components periodically into the openings 246 of conveying belt 229 may be employed; similarly, manual loading may be utilized, if desired. Each of the said components is loaded so that the leads extend downwardly as seen e.g. in FIGS. 7 and 8, and loading table 205 is provided with a longitudinally extending slot 268 which runs the length of the table beneath belt 229 and accommodates the downwardly extending leads 260. The loading table 205 is formed of an electrically insulating material, such as for example a PVC-type plastic or so forth.

The belts 229 and 270, which now carry the components 248, are seen to advance from drive roller 233 toward electroplating station 227. One difficulty with prior apparatus such as of the Johnson type discussed, has been that the conveying belt, as it approaches the electroplating station, may not be sufficiently rigid or accurately positioned as to assure proper contact is made with the applicator means. In the present apparatus this difficulty is obviated by the guide means 225, best seen in the perspective fragmentary view of FIG. 9.

Guide means 225 comprises a support member 226 which is secured to the frame of stand 203, and a pair of longitudinally extending members 288 and 290. The latter are of P-shaped cross-section, and together define a longitudinally extending channel 292 which extends the length of the guide, and is of sufficient height to accommodate the upwardly extending lead of the conveyed components. The bottom surface 294 of guide 225 is positioned somewhat below the lower points of rollers 231 and 233. In consequence, as the belts 229 and 270 progress through channel 292 in overlying contact with shoulders 296 and 298, they are under tension. This, in turn, produces a firm seated contact upon the said shoulders, assuring that as the two belts pass through guide 225, they are maintained in firm contact with the sandwiched components; and similarly spacing of the components with respect to the underlying applicator means is accurately maintained. In order, further, to enable adjustment of the contact arrangement between the progressing components and the underlying rotating applicator means, height-adjusting screws 300 and 302 are provided which enable vertical displacement of members 288 and 290 — which slide upon guide posts 304 and 306 which project from member 226.

With the aid of the foregoing, the overall operation of the present device may be readily comprehended. In particular, each of the said components is rendered cathodic by suitable application of potential (from a power supply 305) between the components and leads on the one hand, and the backside of applicator sleeve 219. Power supply 305 may be present in module 310, which also contains conventional switching means for activating the apparatus, protective circuits, and so forth. Electrical contact with the conductive (cathodic) conveying belt 229 is preferably made by a sliding contact 303. Such contact may suitably comprise any of numerous devices well-known for this purpose, as for example, a graphite brush, wire brush or so forth. Similarly, an anodic potential is provided, by means of a sliding electrical contact which is continuously made with the electrically conductive cylindrical roller 217. Such contact may be made internally, that is, by a lead contact 307 which extends along the axis of the said cylinder, and then outwardly to the inner circumference thereof, where contact is effected.

It will be evident that as the components 248 pass through the electroplating station, the guide means 225 maintains proper contact with the wetted surface of the rotating applicator means. In accordance with one of the aspects of the present invention, a suitable rate of rotation of cylinder 217 is maintained — with respect to the rate of conveyance of the components by belts 229 and 270 — that each of the progressing components continuously overlies fresh electroplating.

The cylindrical roller and fabric sleeve which have been heretofore described, constitute a preferred form of applicator means for use in the present invention. The described arrangement, is in particular, simple to control, exceedingly compact, and is readily repaired or replaced — thereby minimizing down-time for servicing the electroplating apparatus. It should be appreciated, however, that other applicator means, as have been described in connection e.g. with the Johnson apparatus, can be similarly utilized with the invention. This is to say that belt-like arrangements may be suitably employed, provided that an appropriate vector velocity of belt movement in comparison to the vector velocity of the electronic components is utilized — as to assure that fresh electroplating solution is applied to the portions of said components to be plated as they progress in contact with the applicator surface.

As the belts 229 and 270 move beyond electroplating station 227 — and in particular move to and beyond roller 278 — they diverge and proceed in their respective, generally overlying loops. The plated components, now no longer retained in their nested positions, are free to br discharged from belt 229, and due to gravity, fall at about location 311 to a suitable receptacle, or to a product conveyor belt or the like which is positioned below the discharge location.

The extremely compact arrangement of apparatus 201, further, is particularly suitable to a dual (or multiple) processing line operation. It will thus be noted in this connection that portions of a second, parallel-running processing line, are evident in FIG. 6 — including, for example, the longitudinally extending slot **268*a* in loading table 205, rollers 272*a*, 274*a*, etc. These several elements are arranged on the far side of apparatus 201 so as to function precisely as their counterparts on the rear side of the apparatus. The motor 237, through a common power train, drives the conveying and keeper belt on the far side of the apparatus; and both production lines may pass through the same solution trough 213, with the same power supply 305 (FIG. 7**) similarly being used for both lines.

While the present invention has been particularly described in terms of specific embodiments thereof, it should be appreciated in veiw of the instant disclosure, that numerous variations upon the invention are now enabled to those skilled in the art, which variations yet reside within the scope of the present teaching. Accordingly, the invention is to be broadly construed, and limited only by the scope and spirit of the claims now appended hereto.

I claim:

1. Apparatus for continuous electroplating of selected portions of discrete electronic components of the type comprising an electrically conductive body terminating in a die-receiving face; a lip portion formed about said body above said face, said lip portion being of greater diameter than said face; and a plurality of electrical contacts formed as insulated islands at said die-receiving face, with flexible wire leads being connected to at least some of said contacts and extending oppositely from said die-receiving face beyond the body of said component, but said leads being electrically insulated from said body; said selected portions to be electroplated being said die-receiving face and said electrical contacts; and said apparatus comprising:

an electroplating station;

moveable applicator means adapted for carrying electroplating solution on a surface thereof;

means for continuously moving at least a portion of said applicator means surface through said electroplating station;

means for applying electroplating solution to said applicator means surface;

an electrically conductive conveyor belt means, having spaced openings therein for receiving said component bodies in nesting relationship, the periphery of said openings supporting said bodies at said lip portions so that said leads extend through said openings and said die-receiving faces project beyond the plane of said belt means;

lead contact means electrically continuous with said conveyor belt means, abounding each said opening, for surrounding the group of said leads extending from the component nested in said opening, and effecting a ring-like contact with said group, to provide electrical continuity between said leads and conveyor belt means;

said spaced openings of said conveyor belt being defined by formed out cups in said conveying belt, said cups being open at the bottom to define a rim portion electrically continuous with said conveyor belt means and of diameter less than the diameter of said openings, said rim portion being spaced from the periphery of said openings, said rim portion being spaced from the periphery of said openings on the side of said belt means opposite that supporting said lip portions, whereby said rim portion may surround and engage said extending group of wire leads to provide said ring-like contact with said group and thereby constitute said lead contact means;

means for maintaining said components in said nested positions in contact with said belt means and lead contact means; said means including a keeper belt, and means for bringing said keeper belt into contact with a portion of said component non-adjacent said conveying belt to sandwich said component;

a stationary conveyor belt guide means being mounted in fixed spaced relationship with respect to said moveable applicator means, and having a channel therethrough, through which said conveyor belt means passes, said guide means restraining the movement of said components other than in the direction of conveyance of said belt means, the said components being thereby conveyed across the surface of said applicator means with said projecting die-receiving face and said electrical contacts in contact with said electroplating solution on said applicator means;

means for moving said conveyor belt, keeper belt and sandwiched components together through said guide means at said electroplating station;

the direction of movement of said conveyed components through said guide means being such in relationship to said movement of said applicator means that the trace of each said component on the surface of said applicator means continuously overlies fresh electroplating solution; and means for applying a D.C. electrical potential between said conveyor belt means, and electrically continuous component leads, and the side of said applicator means surface opposite said components, whereby to enable plating of said die-receiving faces and said contact present at said faces.

2. Apparatus in accordance with claim 1, wherein said keeper belt includes openings spaced along the length thereof, said openings registering with the openings of said conveyor belt at least through said electroplating station, with said body of said component projecting through said keeper belt openings for contacting said applicator means.

3. Apparatus in accordance with claim 2, wherein said conveyor and keeper belts are formed as generally opposed and overlying loops, said loops abounding one another through said electroplating station to sandwich said components and diverging beyond said electroplating station to permit discharge of said components.

4. Apparatus in accordance with claim 1, wherein said applicator means comprises a conductive cylindrical roller provided with a porous covering for holding said electroplating solution applied thereto.

5. Apparatus for continuous electroplating of selected portions of discrete electronic components of the type comprising an electrically conductive body terminating in a die-receiving face; a plurality of electrical contacts formed as insulated islands at said die-receiving face; with flexible wire leads being connected to at least some of said contacts and extending oppositely from said die-receiving face beyond the body of said components, but said leads being electrically insulated from said body; said selected portions to be electroplated being said die-receiving face and said electrical contacts; and said apparatus comprising:

an electroplating station;

a moveable applicator means adapted for carrying electroplating solution on a surface thereof;

means for continuously moving at least a portion of said applicator means surface through said electroplating station;

means for applying electroplating solution to said applicator means surface;

a moveable electrically conductive conveyor belt, including spaced openings therein for receiving said component bodies in nesting relationship with said leads and die-receiving faces extending oppositely from said openings beyond the plane of said belt; said conductive belt being deformed adjacent each said opening to form a ring-like lead contact means electrically continuous with said conductive belt, said means surrounding and contacting said extending leads at a position beyond the plane of said surface to provide electrical continuity between said leads and said belt;

means for maintaining said components in said nested positions in contact with said conductive conveyor belt and said lead means; said means including a keeper belt, and means for bringing said keeper belt into contact with a portion of said component non-adjacent said conveying belt to sandwich said component;

means for spacing said conductive conveyor belt with respect to said applicator means;

means for moving said conductive conveyor belt and keeper belt continuously and past said spaced applicator means so that said borne and sandwiched components are conveyed across the surface of said applicator means with said projecting die-receiving face and electrical contacts in contact with said electroplating solution on said applicator means; and means for applying a D.C. electrical potential between said conductive conveyor belt and the side of said applicator means opposite said components, whereby to enable plating of said die-receiving faces and said contacts present at said faces.

6. Apparatus in accordance with claim 5, wherein said keeper belt includes openings spaced along the length thereof, said openings registering with the openings of said conveyor belt at least through said electroplating station, with said body of said component projecting through said keeper belt openings for contacting said applicator means.

7. Apparatus in accordance with claim 6, wherein said conveyor and keeper belts are formed as generally opposed and overlying loops, said loops abounding one another through said electroplating station to sandwich said components and diverging beyond said electroplating station to permit discharge of said components.

8. Apparatus in accordance with claim 5, wherein said applicator means comprises a conductive cylindrical roller provided with a porous covering for holding said electroplating solution applied thereto.

9. Apparatus in accordance with claim 6, wherein said means for spacing said conductive surface comprises a stationary conveyor belt guide means mounted in fixed spaced relationship to said moveable applicator means, and having a channel therethrough, through which said conveyor and keeper belt means passes, said guide means restraining the movement of said components other than in the direction of conveyance of said belt means, the said components being thereby conveyed across the surface of said applicator means with said projecting die-receiving face and said electrical contacts in contact with said electroplating solution on said applicator means.

* * * * *